United States Patent [19]

Barger

[11] Patent Number: 4,468,643

[45] Date of Patent: Aug. 28, 1984

[54] MAGNETIC CIRCUIT ADJUSTABLE BY TAPERED SCREWS

[75] Inventor: Dale M. Barger, Los Altos, Calif.

[73] Assignee: Varian Associates, Inc., Palo Alto, Calif.

[21] Appl. No.: 395,392

[22] Filed: Jul. 6, 1982

[51] Int. Cl.[3] ..... H01P 1/218; H01F 3/00

[52] U.S. Cl. ..... 333/202; 335/298

[58] Field of Search ..... 335/298, 297, 299, 301, 335/284; 333/202, 201, 219, 206, 207

[56] References Cited

U.S. PATENT DOCUMENTS 3,418,538 12/1968 Roman ..... 335/298 X
3,437,963 4/1969 Gang et al. ..... 335/298
3,879,677 4/1975 Arnold ..... 331/77
4,247,837 1/1981 Mezak et al. ..... 333/202

*Primary Examiner*—Paul L. Gensler
*Assistant Examiner*—Benny Lee
*Attorney, Agent, or Firm*—Stanley Z. Cole; Keiichi Nishimura

[57] ABSTRACT

The two magnet structures for establishing therebetween a magnetic field for a multi-stage electromagnetically-tuned filter are provided with tapered machine screws each of which can change the separation between the structures at the point where that screw is mounted so that the pole pieces defining the magnetic field can be tilted in any direction with respect to each other while the filter is operating.

9 Claims, 2 Drawing Figures

MAGNETIC CIRCUIT ADJUSTABLE BY TAPERED SCREWS

BACKGROUND OF THE INVENTION

The present invention relates to a magnetic circuit which can be adjusted easily, and more specifically to an electromagnetically-tuned filter with magnetic poles which can be tilted for adjustment while the filter is operating in test setup.

In a multi-stage electromagnetically-tuned filter, a plurality of ferromagnetic resonators are typically positioned within the same applied magnetic field established between the same set of magnetic pole pieces so that they will ideally resonate at exactly the same frequency. Such resonators are disclosed, for example, in U.S. Pat. No. 3,544,918 issued Dec. 1, 1972 to W. E. Venator, Jr. and U.S. Pat. No. 3,879,677 issued Apr. 22, 1975 to C. A. Arnold. As a practical matter, however, fine adjustments of the magnetic field are necessary because of the existence of edge effects and other types of irregularity, and a most popular method for achieving this tracking has been to place a shim of proper thickness at an appropriate position, for example, between the magnetic circuit structure and the support structure, to tip the pole piece, but this method is not satisfactory because the magnetic circuit structure which typically includes a coil housing which must be removed each time the thickness or position of the shim is changed and the results of adjustments cannot be observed until the filter is reassembled and connected in the test setup. In short, the conventional method of achieving this tracking has been a very difficult time-consuming task.

SUMMARY OF THE INVENTION

It is an object of the present invention to provide a method for adjusting a magnetic field by tilting magnetic pole pieces with tapered machine screws.

It is another object of the present invention to provide a magnetic circuit for a multi-stage electromagnetically-tuned filter which can be adjusted easily and quickly while the filter is operating so that each resonator will resonate at exactly the same frequency.

DETAILED DESCRIPTION OF THE INVENTION

Figure 1:
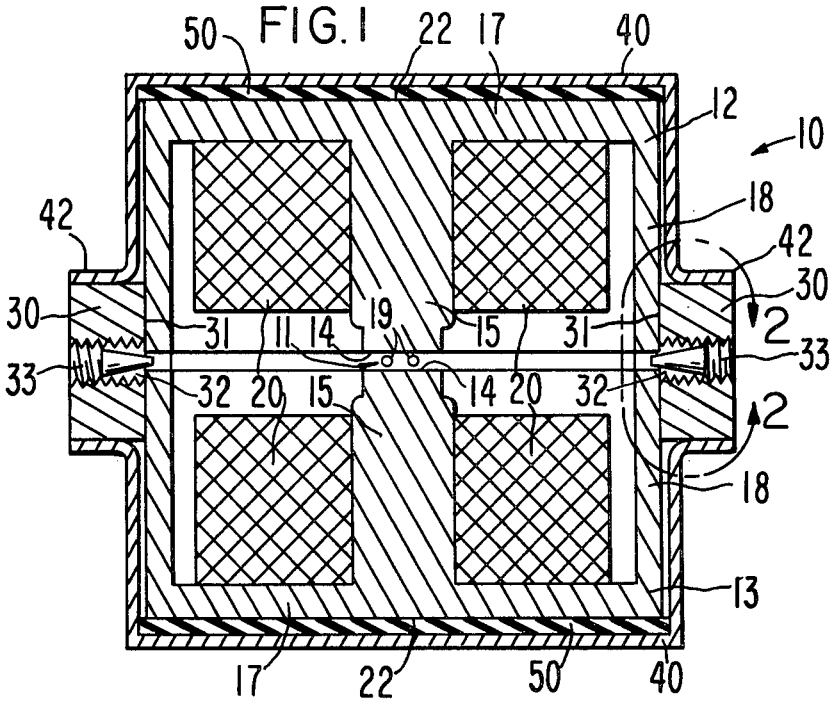
FIG. 1 is a sectional view of an assembly for providing a magnetic circuit incorporating the present invention.

Referring now to FIG. 1, there is shown a magnetic circuit 10 incorporating the present invention. This circuit may typically be used for a multi-stage electromagnetically-tuned filter and a magnetic field to be used for such purposes is created in gap 11 of two identically structured and symmetrically disposed magnetic circuit structures 12 and 13, or more specifically, between their pole pieces 14. Ferro-magnetic resonators such as YIG resonators 19 may be placed in this magnetic field.

Structures 12 and 13 are each a single piece of magnetic material such as a nickel-iron alloy which may typically be used for an electromagnet and essentially consists of a generally cylindrical magnetic core piece 15 and a housing member which is generally shaped like a cup having a disc-shaped bottom piece 17 and a tubular wall 18. One end of core 15 attaches to bottom piece 17, while the other end thereof is the pole piece 14, facing gap 11. The useful magnetic field in gap 11 is established by a current source (not shown) with magnetizing coils 20 which are housed inside the walls 18 and wound around cores 15. The external side of each bottom piece 17, i.e., the side distal core 15, is a flat circular surface 22.

Structures 12 and 13 are positioned symmetrically with respect to each other, sandwiching therebetween an annular support piece 30 also of magnetic material having a cylindrical inner wall 31 along which structures 12 and 13 can be slidably moved. The annular support piece 30 is provided in its center section with four tapered machine screws 33 and four matching spirally grooved holes 32 (two each of which being shown in FIG. 1) nearly equally spaced around the circumference of the annular piece 30, i.e., about 90° apart. The screws 33 can move inside the holes 32 radially by turning with the tapered ends protruding inwardly from the inner wall 31 by variable amounts. The walls 18 of structures 12 and 13 which can slidably move along the inner wall 31 are held compressed against the tapered ends of the screws 33 by means of metallic end pieces 40 so as to form a magnetic circuit which is completely closed except for gap 11. Each of the end pieces 40 is shaped like a hat and comprises a flat bottom section and a rim-like peripheral flange section 42. The flange section 42 is provided with holes and can be fastened to support piece 30 by means of screws (not shown). A flat disc-shaped silicone rubber piece 50 is placed on top of, and substantially entirely covers each of the flat surfaces 22 of the bottom pieces 17. The bottom sections of the end pieces 40 are designed not only to cover silicone rubber pieces 50 substantially entirely, but also to adjustably compress structures 12 and 13 against the tapered ends of the screws 33, the compressive pressure being controlled by appropriately selecting the dimensions of covers 40 and the silicone rubber pieces 50.

Figure 2:
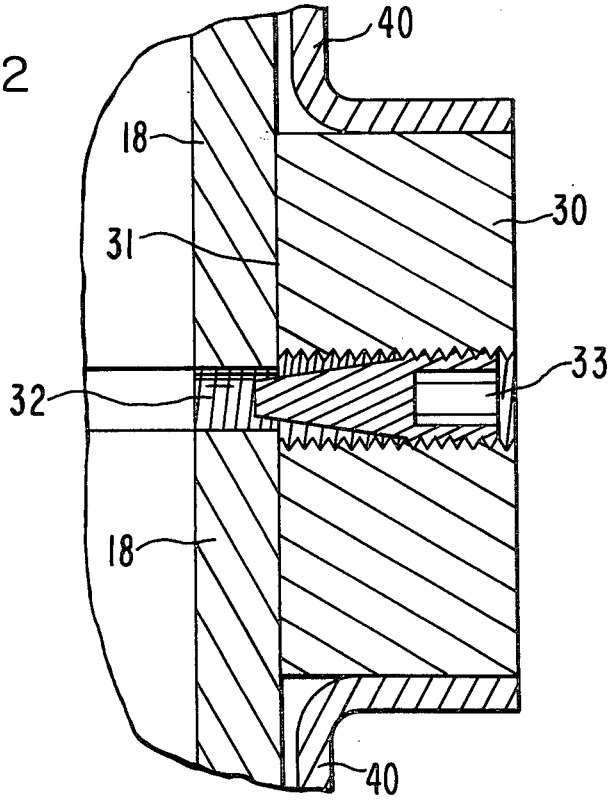
FIG. 2 is an enlarged view of a circled section of FIG. 1.

FIG. 2 shows an enlarged view of the encircled portion of FIG. 1. It is to be understood that the tapering angle must be small enough to allow fine adjustment of the separation between the structures 12 and 13 across the screw 33. It is also to be understood that the structures 12 and 13, although designed to slide along the inside wall 31 reasonably tightly, can be tilted with respect thereto by turning one or more of the screws 33. The pole pieces 14, therefore, can be tilted with respect to each other in any direction by these screws 33 within a certain limit and this can be done while the filter being served by this magnetic circuit 10 is operating in a test setup and the filter response is being observed. Thus, perfect tracking over a wide frequency band can be achieved quickly and easily.

The present invention has been described above in terms of only one specific embodiment. The above description, however, is to be considered as illustrative rather than limiting, and this invention is accordingly to be broadly construed. For example, the magnetic circuit is not intended to be exclusively for use in an electromagnetically-tuned filter and a structure or an assembly of structures which establishes the magnetic circuit of interest can be almost of any convenient shape and/or magnetic material. A supporting structure, annular or otherwise, may be absent as long as a means is provided for two clamped pieces of magnetic material which are maintained at a set relative position. Alternatively, the circuit may be so designed that only one of the magnetic circuit structures 12 and 13, and hence only one of the pole pieces 14, can be tilted by turning one or more of the screws 33. The number of screws need not be four. Since it generally takes three points to define a plane, three screws may theoretically be sufficient. These screws, furthermore, may be replaced by any similar adjustably movable mechanical pieces with a coneshaped section. The scope of the invention is defined only by the following claims.

What is claimed is:

1. A method of causing resonators of a multi-stage electromagnetically-tuned filter disposed inside a magnetic field region to resonate at a same frequency while said filter is operating, said method comprising the step of providing a small number of tapered machine screws, the tapered parts of which are generally in contact with and sandwiched between two magnet assemblies and the step of moving one or more of said screws axially to adjustingly change the relative orientation of said magnet assemblies.

2. The method of claim 1 wherein each of said magnet assemblies comprises a tubular wall and a magnetic pole piece.

3. The method of claim 2 wherein said step of providing machine screws includes mounting said tapered machine screws nearly equally spaced around the circumference of said tubular wall.

4. A magnetic circuit comprising two magnet assemblies for establishing a useful magnetic field therebetween and a small number of adjustably movable tapered machine screws in contact with at least one of said magnet assemblies so that it is possible to tilt said assemblies in any direction with respect to each other by adjustably moving one or more of said tapered machine screws.

5. The magnetic circuit of claim 4 further comprising a supporting structure for maintaining said magnet assemblies in a substantially fixed relative position with respect to each other, said movable tapered machine screws being mounted inside holes provided in said structure.

6. The magnetic circuit of claim 5 wherein said supporting structure has a tubular wall, said magnetic circuit further comprising pole pieces for defining said useful magnetic field therebetween, said pole pieces being positioned substantially on the central axis of said tubular wall.

7. The magnetic circuit of claim 6 wherein said machine screws are mounted nearly equally spaced around the circumference of said tubular wall.

8. The magnetic circuit of claim 7 wherein said small number is four.

9. The magnetic circuit of claim 5 wherein the tapered parts of said tapered machine screws are in contact with and sandwiched between said two magnet assemblies.

* * * * *